US007578778B2

(12) United States Patent
Inoue et al.

(10) Patent No.: US 7,578,778 B2
(45) Date of Patent: Aug. 25, 2009

(54) CREASING DEVICE

(75) Inventors: Hirohisa Inoue, Hyogo (JP); Yukihiro Noto, Hyogo (JP); Junjiro Watanabe, Osaka (JP)

(73) Assignee: Pengo Co., Ltd., Osaka (JP)

( * ) Notice: Subject to any disclaimer, the term of this patent is extended or adjusted under 35 U.S.C. 154(b) by 207 days.

(21) Appl. No.: 11/909,217

(22) PCT Filed: Apr. 13, 2006

(86) PCT No.: PCT/JP2006/307822

§ 371 (c)(1),
(2), (4) Date: Sep. 20, 2007

(87) PCT Pub. No.: WO2006/112348

PCT Pub. Date: Oct. 26, 2006

(65) Prior Publication Data

US 2009/0062098 A1 Mar. 5, 2009

(30) Foreign Application Priority Data

Apr. 14, 2005 (JP) ..... 2005-117280

(51) Int. Cl.
*B31B 1/25* (2006.01)

(52) U.S. Cl. ..... 493/59; 493/60; 493/64

(58) Field of Classification Search ..... 493/59, 493/60, 61, 62, 64
See application file for complete search history.

(56) References Cited

U.S. PATENT DOCUMENTS

| | | | | |
|---|---|---|---|---|
| 3,332,326 | A | 7/1967 | Haas | |
| 4,142,455 | A * | 3/1979 | Coburn | 493/361 |
| 4,413,541 | A * | 11/1983 | Biggar, III | 83/346 |
| 4,922,778 | A | 5/1990 | Nagai | |
| 5,131,900 | A | 7/1992 | Schroeder | |
| 6,478,725 | B1 * | 11/2002 | Bengt et al. | 493/59 |
| 6,508,751 | B1 * | 1/2003 | Weishew et al. | 493/59 |

FOREIGN PATENT DOCUMENTS

| | | |
|---|---|---|
| JP | 1-109017 | 4/1989 |
| JP | 4-226336 | 8/1992 |
| JP | 2001-30376 | 2/2001 |

* cited by examiner

*Primary Examiner*—Sameh H. Tawfik
(74) *Attorney, Agent, or Firm*—Wenderoth, Lind & Ponack, LLP.

(57) ABSTRACT

It is desired to provide a creasing device of which the distances between rollers of a plurality of creasing units are individually adjustable.

A plurality of creasing units 40 each comprising a female creasing roll 41 and a male creasing roll 42 provided thereunder are provided so as to be positionable in a direction perpendicular to the feed direction of a corrugated sheet S0. As many roller arms 43 as the creasing units 40 are provided so as to be pivotable about a common first drive shaft 31. Each roller arm 43 rotatably supports one of the male creasing rolls 42. By pivoting each roller arm 43 with a pivoting means 45, the male creasing roll 42 is moved relative to the corresponding female creasing roll 41, thereby adjusting the distance between the rolls.

1 Claim, 8 Drawing Sheets

CREASING DEVICE

TECHNICAL FIELD

This invention relates to a creasing device for forming creases in sheets such as corrugated sheets and cardboard sheets along which the sheets are folded, by feeding such sheets in one direction.

BACKGROUND ART

A typical conventional creasing device comprises two rotary shafts provided one over the other to extend parallel to each other, a plurality of male creasing rolls mounted on the lower rotary shaft so as to be axially positionable, and a plurality of female creasing rollers as backing rolls each corresponding to one of the male creasing rolls and mounted on the upper rotary shaft so as to be axially positionable, whereby when a corrugated sheet is fed between the male creasing rolls and the female creasing rolls, creases are formed in the sheet by pressing ribs formed on the outer periphery of the male creasing rolls against the sheet (Patent document 1).

In such a creasing device, when forming creases in relatively thick corrugated sheets, such sheets tend to be pressed too hard by the creasing rolls, so that liners forming the surface layers of such sheets tend to crack near the creases. When forming creases in relatively thin corrugated sheets, because such sheets are pressed too weakly by the creasing rolls, no clear creases are formed, so that such sheets cannot be folded along the creases with high accuracy. Thus, such creasing devices include means for adjusting the distances between the male creasing rolls and the female creasing rolls according to the thickness of the corrugated sheet.

In a typical known creasing device of which the distances between the rolls is adjustable, at least one of the upper and lower rotary shafts has both ends thereof rotatably supported by eccentric bearings, whereby by rotating the eccentric bearings and thus rotating the axis of the one of the rotary shafts, the distances between the axes of the upper and lower rotary shafts is adjustable.

Patent document 1: JP Patent Publication 2001-30376A

DISCLOSURE OF THE INVENTION

Object of the Invention

In a conventional creasing device of the type in which the distances between the male creasing rolls and the female creasing rolls are adjustable by rotating the eccentric bearings, the distances between the male creasing rolls and the female creasing rolls of the plurality of creasing units are adjusted simultaneously by the same amount. This device has the following problems.

Especially with a corrugated sheet, because a corrugated sheet includes corrugated medium, the resistance to pressing force is uneven over the entire area of the sheet. Thus, when longitudinal creases are formed by pressing the ribs of the male creasing roll against such a corrugated sheet, the liner forming the surface layer of the corrugated sheet may be cracked or broken at its portions where the resistance to pressing force is low. If the distances between the rolls are adjusted such that the distances between the male creasing rolls and the female creasing rolls increase in order to prevent such cracks or breakage, the distances between the rolls of the creasing units for forming creases in the corrugated sheet at its portions where the resistance to pressing force is high also increases, so that no clear creases can be formed at such portions due to insufficient creasing pressure. This makes it impossible to fold the corrugated sheet along the creases with high accuracy.

FIG. 10(II) shows a blank S1 to be formed into a corrugated box. This blank S1 is formed from a corrugated sheet S0 shown in FIG. 10(I). Two parallel transverse creases a1 and a2 are formed in the corrugated sheet S0 beforehand.

In forming the blank S1, first to fourth longitudinal creases b1 to b4 are formed in the corrugated sheet S0, a plurality of slots c are formed by grooving in the following step, and then joint portion d is formed by cutting corners.

The blank S1 thus formed is fed to a folding device and the panels P1 and P4 on both sides are folded by 180° along the first and third creases b1 and b3 so that the panel P1 on one side is partially superposed on the joint portion d integral with the panel P4 on the other side and bonded thereto by an adhesive applied beforehand. Thus, a flat box is formed.

In forming the flat box, if the creasing pressure for forming the first and third longitudinal creases b1 and b3 is low, it is impossible to fold the blank S1 along the longitudinal creases b1 and b3, so that the panels P1 and P4 may be inclined relative to each other when they are joined together.

If the panels P1 and P4 on both sides are inclined relative to each other when the blank is formed into a flat box, when it is erected into a three-dimensional box, it tends to be not precisely square in shape, so that such a box is treated as defective.

This problem is avoidable by setting the creasing pressure for the first and third longitudinal creases b1 and b3 higher than the creasing pressure for the second and fourth longitudinal creases b2 and b4. But because none of the conventional creasing devices has the function of individually adjusting the distances between the rolls of the plurality of creasing units, this problem is unavoidable.

An object of the present invention is to provide a creasing device in which the distances between the rolls of the plurality of creasing units are individually adjustable.

Means to Achieve the Object

In order to achieve the above object, the present invention provides a creasing device comprising a plurality of creasing units each comprising a male creasing roll having a creasing rib on its outer periphery, and a backing roll provided so as to vertically oppose the male creasing roll over or under the male creasing roll, the plurality of creasing units being positionable in a direction transverse to a direction in which sheets are fed, wherein creases are formed in sheets while the sheets are being fed between the male creasing rolls and the backing rolls by rotating the male creasing rolls and the backing rolls in opposite directions to each other, characterized in that a plurality positioning means are provided respectively for the plurality of creasing units, each for positioning at least one of the male creasing roll and the backing roll of each creasing unit relative to the other, independently of the rolls of the other creasing units, thereby independently adjusting the distances between the male creasing rolls and the backing rolls of the respective creasing units.

The positioning means may each comprise a roller arm pivotally supported at one end thereof on a drive shaft on which the roller arms of the other positioning means are pivotally supported, and supporting one of the male creasing roll and the backing roll that is to be positioned at the other end thereof, and a pivoting means for pivoting the roller arm about the drive shaft to adjust the distance between the male creasing roll and the backing roll. Alternatively, each of the positioning means may comprise a rotatable eccentric bearing formed with a support hole in which one of the male creasing roll and the backing roll that is to be positioned is rotatably supported, the support hole being located at an offset position relative to the center of rotation of the eccentric shaft, and a driving means for rotating the eccentric bearing.

Advantages of the Invention

As described above, by providing a plurality positioning means respectively for the plurality of creasing units, each for positioning at least one of the male creasing roll and the backing roll of each creasing unit relative to the other, independently of the rolls of the other creasing units, it is possible to individually adjust the distances between the upper and lower pairs of male creasing rolls and backing rolls by operating the positioning means. Thus, it is possible to adjust the creasing pressures for a plurality of creases to be simultaneously formed in a sheet by means of the individual creasing units.

In the positioning means of the type which adjusts the distance between the male creasing roll and the female creasing roll by pivoting the roller arm, the pivoting radius of the roller arm is large, so that the axis of the male creasing roll is less likely to be displaced in the sheet feed direction relative to the axis of the female creasing roll. This makes it possible to form longitudinal creases in various sheets having different thicknesses with high accuracy.

This positioning means of the type in which the distance between the male creasing roll and the backing roll is adjusted by rotating the eccentric bearing is simple in structure. Also, because the distance between the rolls is adjustable by rotating the eccentric bearing, it is possible to use a driving means that is simple structure.

BRIEF DESCRIPTION OF THE DRAWINGS

FIG. 10(I) is a front view of a corrugated sheet; and

DESCRIPTION OF THE NUMERALS

Figure 1:
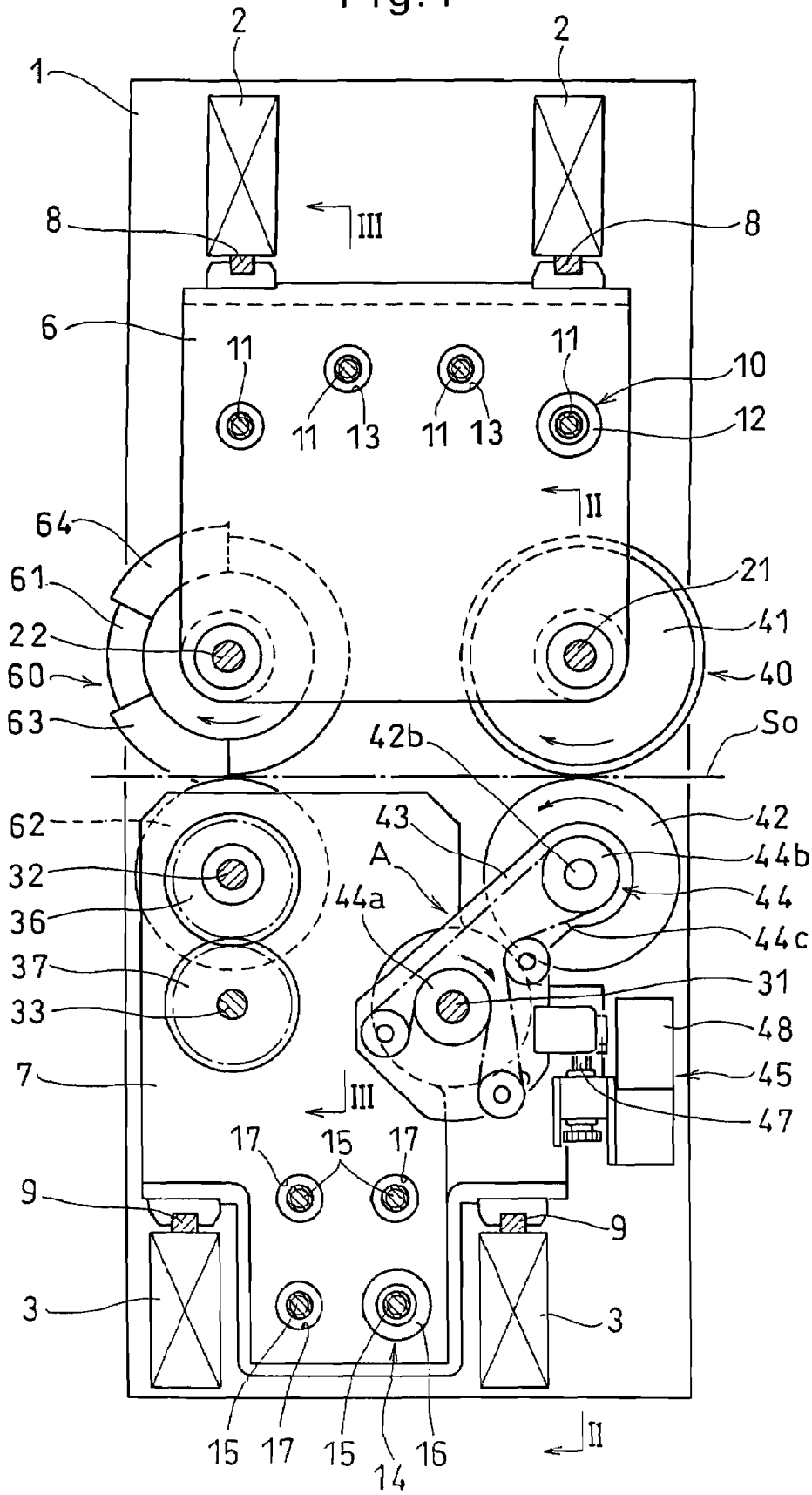
FIG. 1 is a vertical sectional view of a creasing/grooving device in which a creasing device according to the present invention is used.

31. First drive shaft (drive shaft)
40. Creasing unit
41. Female creasing roll (backing roll)
42. Male creasing roll
42*a*. Rib
42*b*. Roll shaft
A. Positioning means
43. Roller arm
45. Pivoting means
90. Eccentric bearing
91. Driving means
92. Cylindrical outer surface
93. Support hole

BEST MODE FOR EMBODYING THE INVENTION

Figure 2:
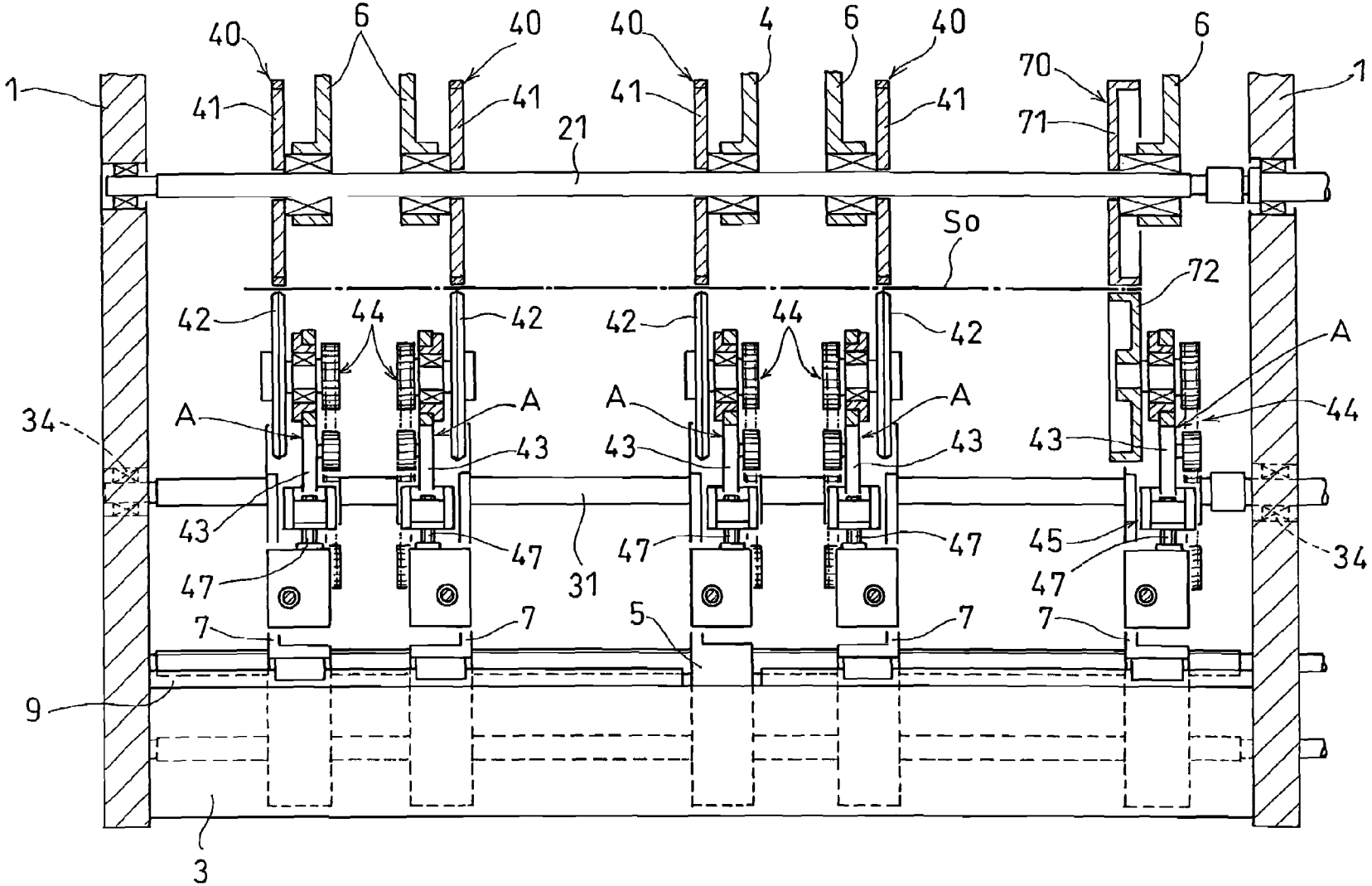
FIG. 2 is a sectional view taken along line II-II of FIG. 1.
Figure 3:
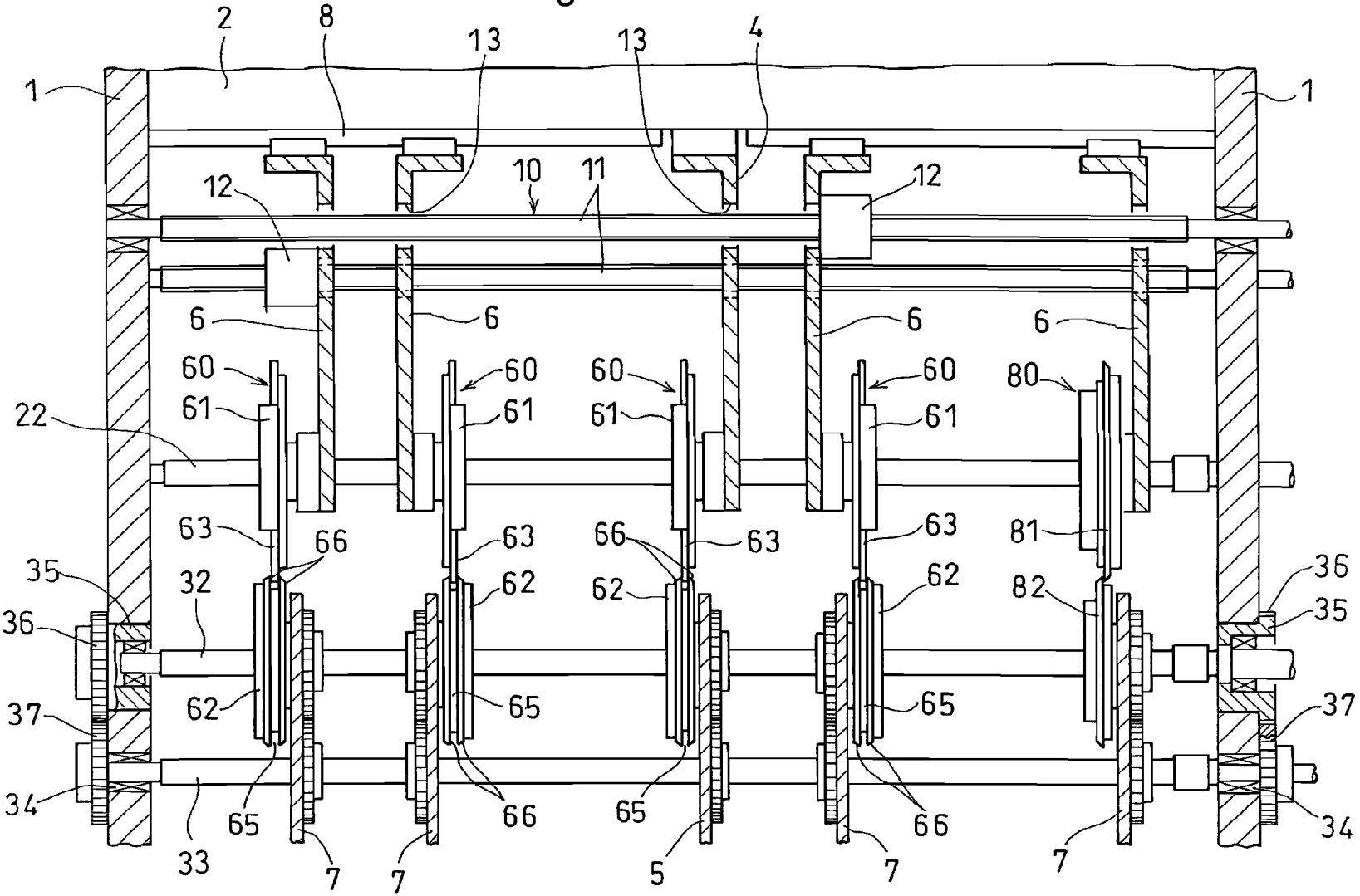
FIG. 3 is a sectional view taken along line III-III of FIG. 1.

Now the embodiment of this invention is described with reference to the drawings. FIGS. 1 to 3 show a creasing/grooving device for grooving and creasing a corrugated sheet S0. The creasing/grooving device includes a pair of side frames 1.

A pair of upper bars 2 and a pair of lower bars 3 extend between the upper and lower portions of the side frames 1 while being spaced from each other in the feed direction of the corrugated sheet S0.

An upper stationary frame 4 and a lower stationary frame 5 are fixed to the longitudinal centers of the pair of upper bars 2 and the longitudinal centers of the pair of lower bars 3, respectively, with the upper frame 4 located right over the lower frame 5.

Two upper movable frames 6 are provided between the upper stationary frame 4 and each of the side frames 1. Four lower movable frames 7 are provided each right under and vertically opposite to one of the four upper movable frames 6.

The four upper movable frames 6 are movable along linear rails 8 fixed to the bottoms of the upper bars 2. The four lower movable frames 7 are movable along linear rails 9 fixed to the tops of lower bars 3.

The four upper movable frames 6 are positionable independently of each other by means of four respective upper thread mechanisms 10, with respect to the upper fixed frame 4. Each upper thread mechanism 10 comprises a threaded shaft 11 extending through the upper movable frames 6, and a nut member 12 fixed to one of the upper movable frame 6 and in threaded engagement with the threaded shaft 11.

FIG. 3 shows only the threaded shafts 11 and the nut members 12 of two of the thread mechanisms for positioning the left ones of the right and left pairs of upper movable frames 6. But the right ones of the right and left pairs of upper movable frames 6 are also similarly positioned by the other two threaded shafts 11 and the nut members 12 in threaded engagement with the other two threaded shafts 11.

Each threaded shaft 11 for positioning one of the upper movable frames 6 extend loosely through holes 13 formed in the other three upper movable frames 6 and the upper stationary frame 4.

The four lower movable frames 7 are positionable independently of each other by means of four respective lower thread mechanisms 14, with respect to the lower fixed frame 5. Each lower thread mechanism 14 comprises a threaded shaft 15 extending through the lower movable frames 7, and a nut member 16 fixed to one of the lower movable frame 7 and in threaded engagement with the threaded shaft 15.

Each threaded shaft 15 for positioning one of the lower movable frames 7 extend loosely through holes 17 formed in the other three lower movable frames 7 and the lower stationary frame 5.

Each threaded shaft 11 for positioning one of the upper movable frames 6 is rotated in synchronism with the threaded shaft 15 for positioning the lower movable frame 7 corresponding to the above one of the upper movable frames 6 by means of a synchronizing mechanism, not shown. Thus, by driving one of the upper or lower threaded shafts, the corresponding pair of upper and lower movable frames 6 and 7 are moved in the same direction by the same distance.

Over the feed path of the corrugated sheet S0, first and second rotary shafts 21 and 22 are provided with the second rotary shaft 22 located downstream of the first rotary shaft 21. Each of the first and second rotary shafts 21 and 22 extends through the four upper movable frames 6 and the upper stationary frame 4 and has both ends thereof rotatably supported by the pair of side frames, respectively. The rotary shafts 21 and 22 are rotated in the direction of the arrows in FIG. 1 by a driving unit, not shown. The first and second rotary shafts 21 and 22 are spline shafts movably supporting the four upper movable frames 6.

Under the feed path of the corrugated sheet S0, first and second drive shafts 31 and 32 are provided with the second drive shaft 32 located downstream of the first drive shaft 31. Under the second drive shaft 32, an adjusting shaft 33 is provided.

As shown in FIGS. 2 and 3, each of the first and second drive shafts 31 and 32 and the adjusting shaft 33 extends through the four lower movable frames 7 and the lower stationary frame 5. Each of the first drive shaft 31 and the adjusting shaft 33 has both ends thereof rotatably supported by bearings 34 mounted to the pair of side frames 1, respectively.

The second drive shaft 32 has both ends thereof rotatably supported by eccentric bearings 35 rotatably supported by the pair of side frames 1.

The first and second drive shafts 31 and 32 and the adjusting shaft 33 are spline shafts each movably supporting the four lower movable frames 7. The first and second drive shafts 31 and 32 are rotated in the direction of the arrow in FIG. 1 by a driving unit, not shown.

As shown in FIGS. 1 and 3, the eccentric bearings 35, which support the second drive shaft 32, each include a gear 36 on the outer periphery thereof at its outer end. The gears 36 each mesh with one of drive gears 37 mounted on both ends of the adjusting shaft 33. Thus, when the adjusting shaft 33 is rotated, the eccentric bearings 35 rotate, so that the central axis of the second drive shaft 32 rotates about the central axis of the outer periphery of the eccentric bearings 35. Thus, by rotating the adjusting shaft 32, the second drive shaft 32 moves up and down, so that it is possible to adjust the distance between the axes of the second rotary shaft 22 and the second drive shaft 32.

As shown in FIGS. 1 and 2, between the upper and lower stationary frames 4 and 5, a creasing unit 40 for creasing the corrugated sheet S0 is provided. Downstream of the creasing unit 40, a grooving unit 60 is provided.

Between each of three of the four upper movable frames 6, which are aligned in the direction perpendicular to the feed direction of the corrugated sheet S0, except the frame 6 on one side, and the lower movable frame 7 corresponding to each of the above three upper movable frames 6, a creasing unit 40 of the same structure as the abovementioned creasing unit 40 is provided. Downstream of each of these creasing units 40, a grooving unit 60 of the same structure as the abovementioned grooving unit 60 is provided.

Between the upper movable frame 6 on the one side and the lower movable frame 7 corresponding to this upper movable frame 6, a press unit 70 is provided for collapsing one side (with respect to the feed direction of the sheet S0) of the corrugated sheet S0. Downstream of the press unit 70, a cutting unit 80 shown in FIG. 3 is provided.

Figure 4:
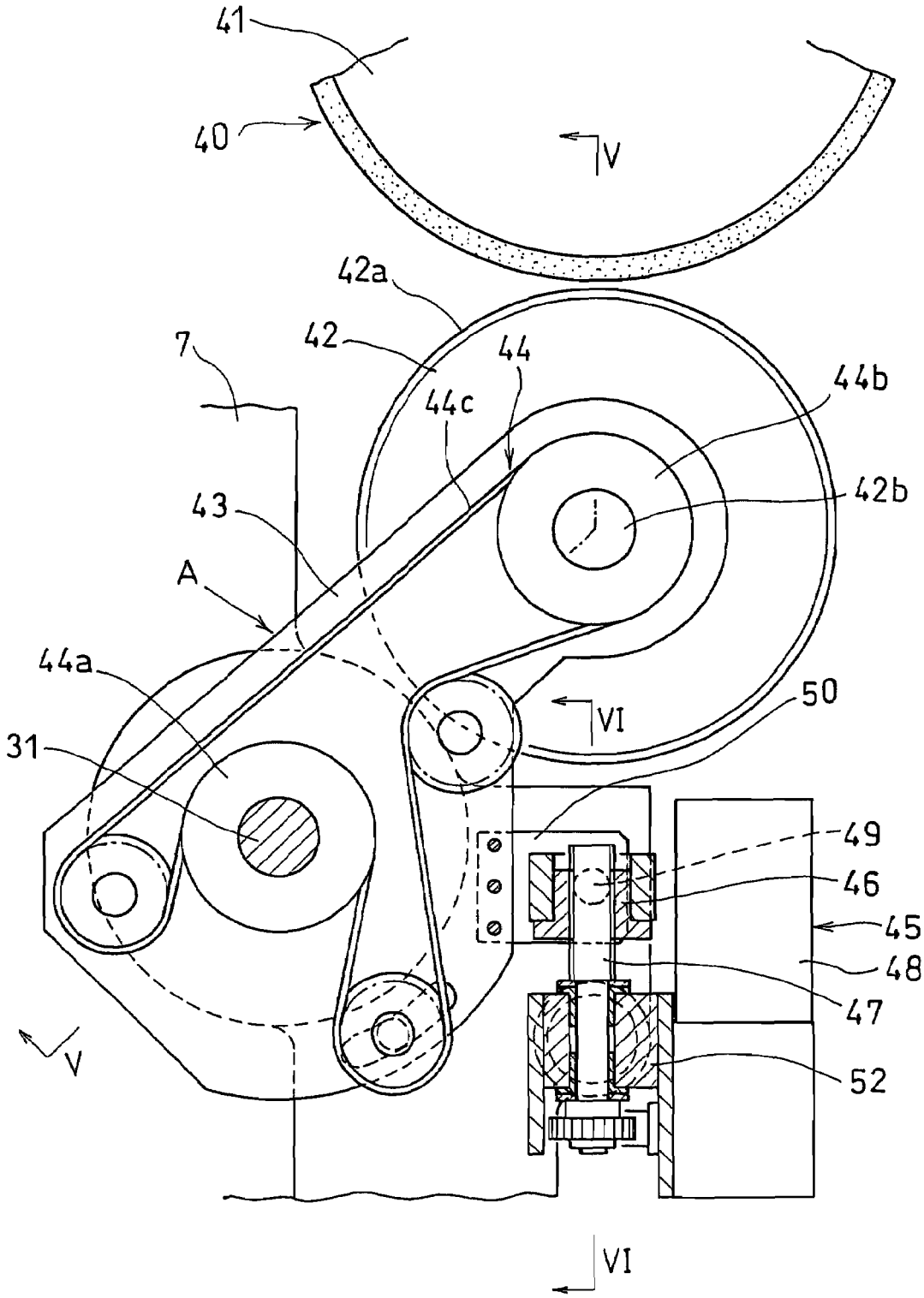
FIG. 4 is an enlarged sectional view of a creasing unit.
Figure 5:
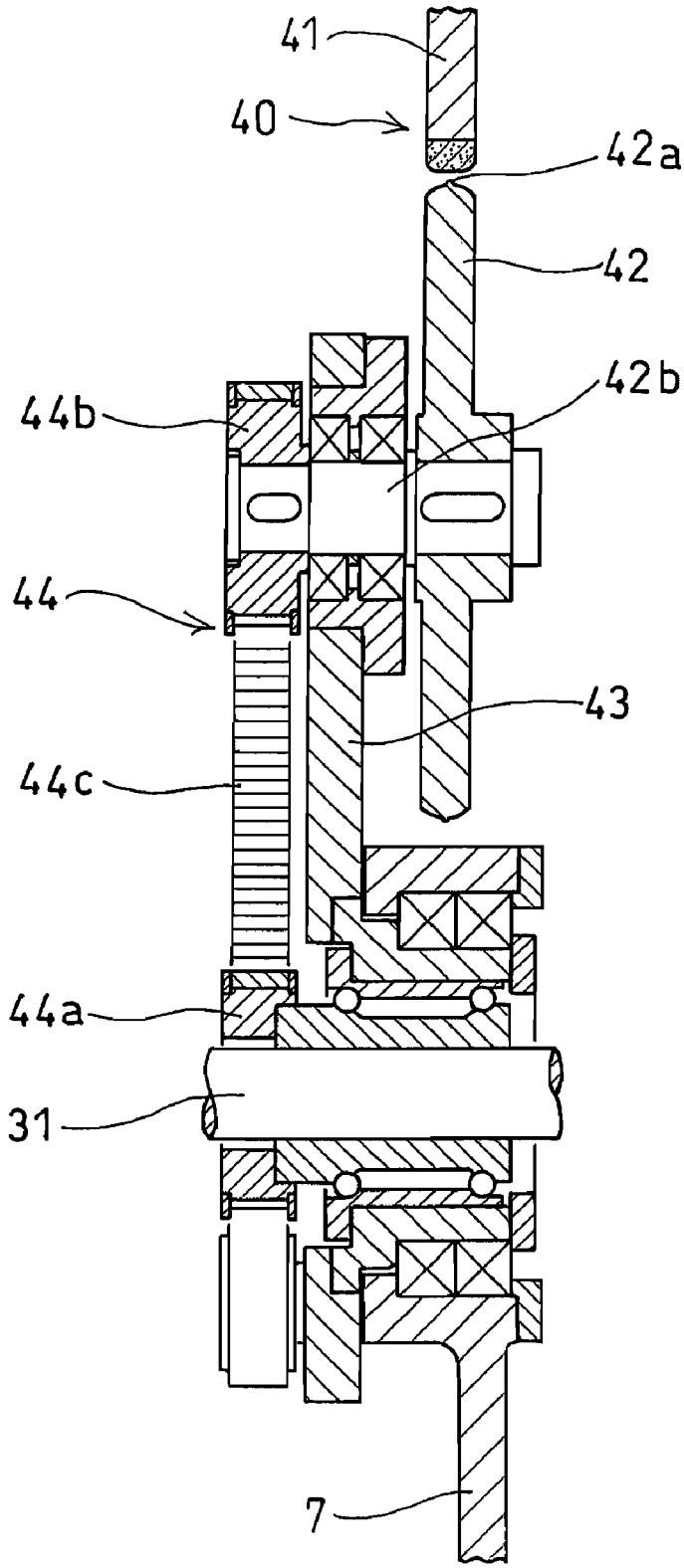
FIG. 5 is a sectional view taken along line V-V of FIG. 4.

As shown in FIGS. 1, 4 and 5, the creasing units 40 each comprise a female creasing roll 41 as a backing roll, a male creasing roll 42 provided under the female creasing roll 41, a positioning means A for positioning the male creasing roll 42 relative to the female creasing roll 41, and a rotation transmission means 44 for transmitting the rotation of the first drive shaft 31 to the male creasing roll 42.

The female creasing rolls 41 are rotationally fixed to the first rotary shaft 21 and are rotatably supported by the upper fixed frames 4 and the upper movable frames 6, respectively. When any of the upper movable frames 6 are moved for positioning, the female creasing roll 41 mounted to this upper movable frame 6 is moved in the axial direction of the first rotary shaft 21 together with the upper movable frame 6.

As shown in FIGS. 4 and 5, the male creasing rolls 42 each have a rib 42*a* for creasing on the outer periphery thereof. The positioning means A for moving each male creasing roll 42 relative to the corresponding female creasing roll 41 to adjust the distance therebetween comprises a roller arm 43 rotatably supporting the male creasing roll 42 and pivotable about the first drive shaft 31, and a pivoting means 45 for pivoting the roller arm 43. The roller arms 43 are each supported by one of the lower stationary frame 5 and the lower movable frames 7. When any of the lower movable frames 7 are moved for positioning, the roller arm 43 mounted to this lower movable frame 7 is moved in the axial direction of the first drive shaft 31 together with the lower movable frame 7.

Figure 6:
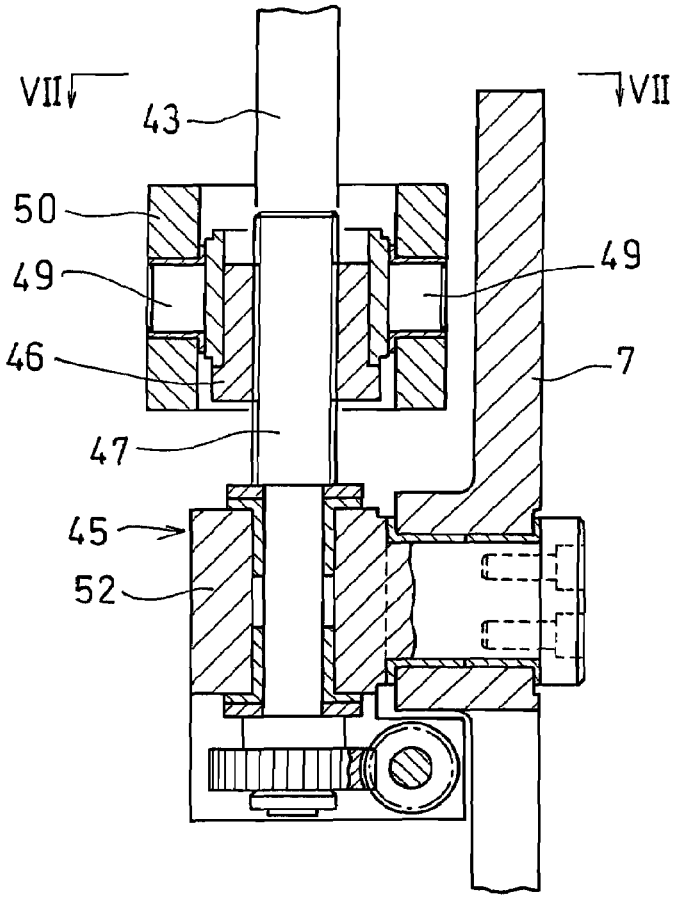
FIG. 6 is a sectional view taken along line VI-VI of FIG. 4.
Figure 7:
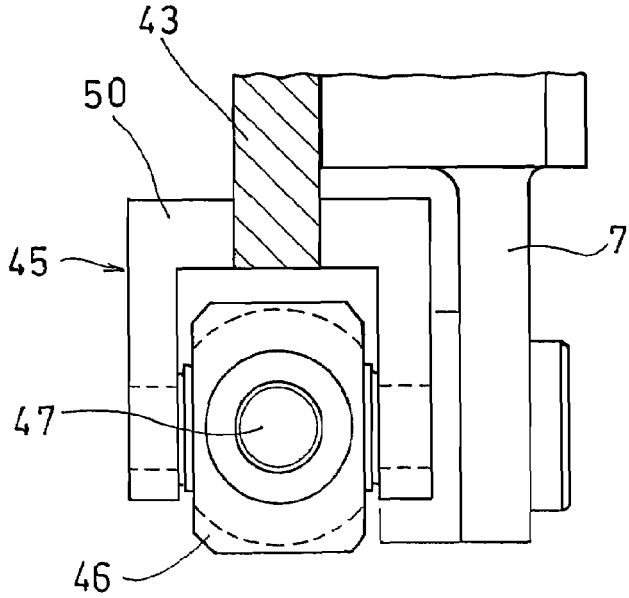
FIG. 7 is a sectional view taken along line VII-VII of FIG. 6.

As shown in FIGS. 4, 6 and 7, the pivoting means 45 comprises a nut member 46, a threaded shaft 47 in threaded engagement with the nut member 46, and a motor 48 for rotating the threaded shaft 47. The nut member 46 has opposed pins 49 on the outer periphery thereof. The pins 49 are rotatably supported by a nut holder 50 which is fixed to the roller arm 43.

The threaded shaft 47 is rotatably supported by a bearing member 52 coupled to one of the lower fixed frame 5 and the lower movable frames 7. The motor 48 is also supported by the bearing member 52. Thus, when the threaded shaft 47 is rotated by driving the motor 48, the nut member 46 moves parallel to the axial direction of the threaded shaft 47, thereby vertically pivoting the roller arm 43 about the first drive shaft 31. Because the male creasing roll 42 is supported on the roller arm 43, when the roller arm 43 pivots, the male creasing roll 42 moves vertically toward or away from the corresponding female creasing roll 41. Thus, it is possible to adjust the distance between each male creasing roll 42 and the corresponding female creasing roll 41.

The rotation transmission means 44 comprises a toothed driving pulley 44*a* rotationally fixed to and axially movably supported by the first drive shaft 31, a toothed driven pulley 44*b* fixed to a roll shaft 42*b* of the male creasing roll 42, and a timing belt 44*c* trained about the toothed pulleys 44*a* and 44*b*. The toothed driving pulley 44*a* is rotatably supported by the roller arm 43.

As shown in FIGS. 1 and 3, the grooving units 60 each comprise an upper rotary blade 61 rotationally fixed to the second rotary shaft 22, and a lower rotary backing blade 62 rotationally fixed to the second drive shaft 32. The upper rotary blade 61 is rotatably supported by one of the upper stationary frame 4 and the upper movable frames 6, and includes two slot blade members 63 and 64 that are circumferentially spaced from each other with the slot blade member 64 circumferentially movable relative to the slot blade member 63.

The lower rotary backing blade 62 is formed with an annular groove in which the slot blade members 63 and 64 of the upper rotary blade 61 are received. The edges of the opening of the annular groove 65 serve as cutting edges 66.

As shown in FIG. 2, the press unit 70 comprises an upper press roll 71 rotationally fixed to the first drive shaft 31, a lower press roller provided under the upper press roll 72, a roller arm 43 rotatably supporting the lower press roll 72 and pivotable about the first drive shaft 31, a rotation transmission means 44 for transmitting the rotation of the first drive shaft 31 to the lower press roll 72, and a pivoting means 45 for pivoting the roller arm 73 about the first drive shaft 31.

Because these rotation transmission means 44 and pivoting means 45 are identical in structure to the rotation transmission means 44 and the pivoting means 45 of each creasing unit 40, their description is omitted with identical elements denoted by identical numerals.

The upper press roll 71 is rotatably supported by the upper movable frame 6 so as to be movable parallel to the axial direction of the first rotary shaft 21 together with the upper movable frame 6 when positioning the upper movable frame 6.

As shown in FIG. 3, the cutting unit 80 comprises an upper slitter blade 81 rotationally fixed to the second rotary shaft 22, and a lower slitter blade 82 rotationally fixed to the second drive shaft 32. The upper slitter blade 81 is rotatably supported by the upper movable frame 6 and is movable parallel to the axial direction of the second rotary shaft 22 together with the upper movable frame 6 when positioning the upper movable frame 6. The lower slitter blade 82 is rotatably supported by the lower movable frame 7 and is movable parallel to the axial direction of the second drive shaft 32 together with the lower movable frame 7 when positioning the lower movable frame 7. The lower slitter blade 82 rotates while kept in contact with the side of the upper slitter blade 81 to cut one side of the corrugated sheet S0 in cooperation with the upper slitter blade 81 when the sheet S0 is fed therebetween.

Now in operation of the creasing/grooving device embodying the invention, when the first rotary shaft 21 and the first drive shaft 31 are rotated, the female creasing roll 41 and the male creasing roll 42 of each of the plurality of creasing units 40 rotate in opposite directions to each other as shown by the arrows in FIG. 1. Simultaneously, the upper and lower press rolls 71 and 72 of the press unit 70 also rotate in opposite directions to each other.

When the second rotary shaft 22 and the second drive shaft 32 are rotated, the upper rotary blade 61 and the lower rotary backing blade 62 of each of the plurality of grooving units 60 rotate in opposite directions to each other as shown by the arrows in FIG. 1. The pair of upper and lower slitter blades 81 and 82 also rotate in opposite directions to each other.

Figure 10:
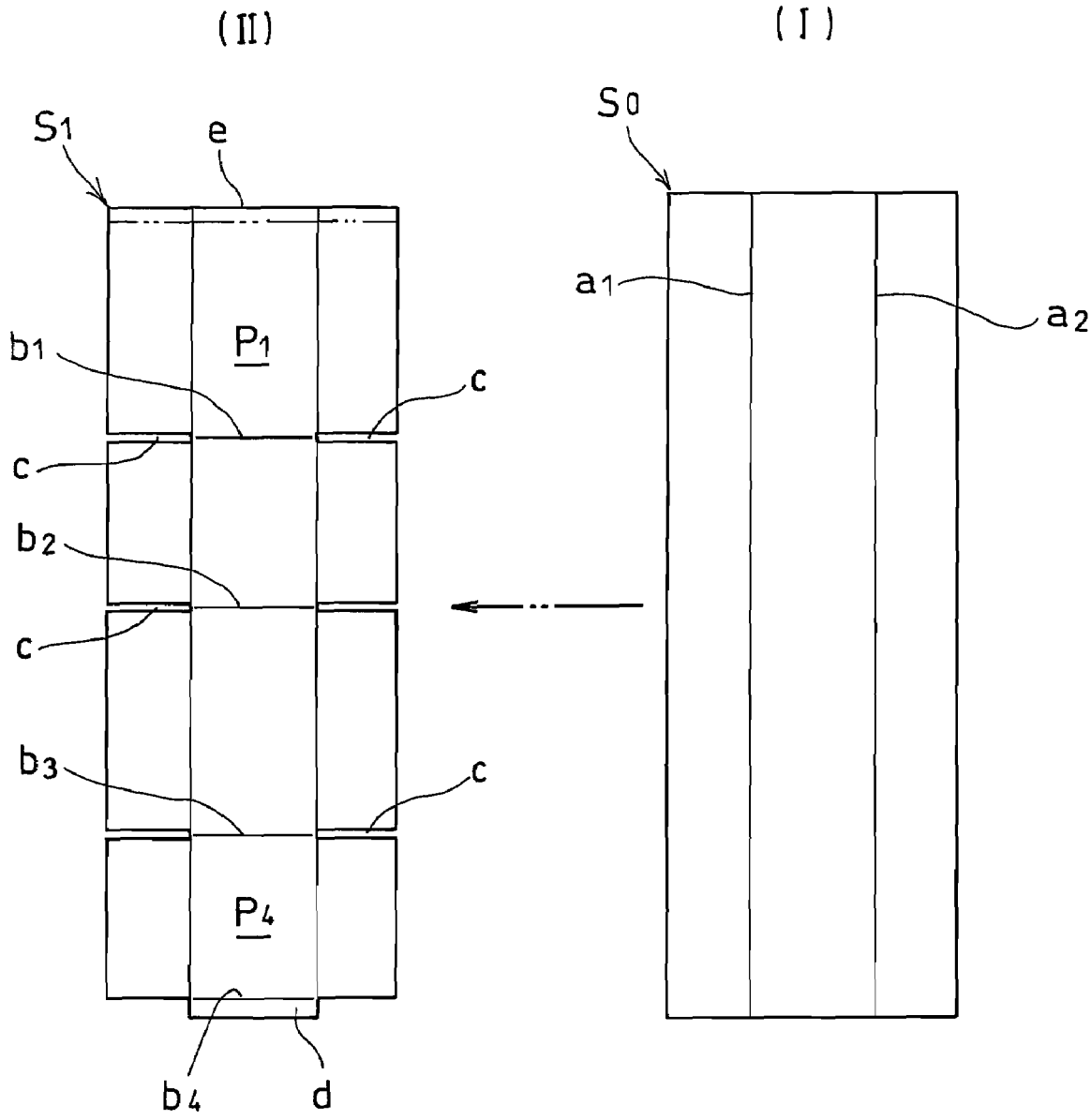
FIG. 10(II) is a front view of a blank formed of the corrugated sheet.

With the first rotary shaft 21, second rotary shaft 22, first drive shaft 31 and second drive shaft 32 rotating, the corrugated sheet S0 shown in FIG. 10(I) is fed. When the sheet S0 passes between the female creasing rolls 41 and the male creasing rolls 42 of the plurality of creasing units 40, the ribs 42*a* on the outer periphery of the male creasing rolls 42 are pressed against the sheet S0, so that four longitudinal creases b1 to b4 are formed in the corrugated sheet S0 as shown in FIG. 10(II). Also, one side of the corrugated sheet S0 is flattened by the upper and lower press rolls 71 and 72 of the press unit 70. The letter e in FIG. 10(II) indicates the flattened thin portion where corrugating medium has been flattened into a thin sheet.

After being formed with creases, the corrugated sheet S0 is fed downstream. When the sheet S0 passes between the upper rotary blades 61 and the lower rotary backing blades 62 of the plurality of grooving units 60, as shown in FIG. 10(II), slots c are formed in the front and rear portions of the corrugated sheet S0 with respect to the feed direction of the sheet S0 by the pairs of slot blade members 63 and 64 mounted on the upper rotary blades 61. Also, the flattened portion e on one side of the corrugated sheet S0 is cut by the upper slitter blade 81 and the lower slitter blade 82 and its excess portion is removed.

The pair of slot blades 63 and 64 of the upper rotary blade 61 that is supported by the left one of the four upper movable frames 6 shown in FIG. 3 have corner cutting edges on sides thereof, and the lower rotary backing blade 62 corresponding to this upper rotary blade 61 has a cylindrical receiving portion for receiving these corner cutting edges. With this arrangement, a joint portion d can be formed by removing the corners of the corrugated sheet S0 on the other side thereof with the corner cutting edges. A blank S1 shown in FIG. 10(II) is thus formed.

In the next step, side panels P1 and P4 are bent and the joint portion d is bonded to the flattened portion e to form a flat box. In this state, since the flattened portion e is thin, the thickness of the box at its transverse center where there is the joint portion d is as thick as other areas of the box.

In forming the longitudinal creases b1 to b4 in the corrugated sheet S0, the distances between the respective female creasing rolls 41 and male creasing rolls 42 are adjusted beforehand.

To change the distance between each pair of creasing rolls, the motor 48 shown in FIG. 4 is driven to turn the threaded shaft 47. When the threaded shaft 47 is turned, the nut member 46, which is in threaded engagement with the threaded shaft 47, moves parallel to the threaded shaft. This causes the roller arm 43 to vertically pivot about the first drive shaft 31, so that the male creasing roll 42, which is supported on the roller arm 43, moves vertically toward or away from the corresponding female creasing roll 41. The distance between the male creasing roll 42 and the female creasing roll 42 is thus adjustable.

Because the distances between the male and female creasing rolls 42 and 41 of the respective creasing units 40 are adjustable independently and separately from each other, if the liner of the corrugated sheet S0 suffer e.g. cracks or breakage near any particular one of the longitudinal creases b1 to b4, it is possible to adjust, i.e. increase, only the distance between the rolls of the creasing unit 40 corresponding to this particular one of the creases b1 to b4, thereby preventing cracks and breakage. Also, because it is possible to increase only the creasing pressure applied to the first and third longitudinal creases b1 and b3 of the blank S1 shown in FIG. 10(II), it is possible to improve the accuracy of folding, thereby forming a flat box that is high in dimensional accuracy.

As shown in the embodiment, in the positioning means A, which adjusts the distance between the male creasing roll 42 and the female creasing roll 41 by pivoting the roller arm 43, the pivoting radius of the roller arm 43 is large, so that the axis of the male creasing roll 42 is less likely to be displaced in the sheet feed direction relative to the axis of the female creasing roll 41. This makes it possible to form longitudinal creases in various sheets having different thicknesses with high accuracy.

Figure 8:
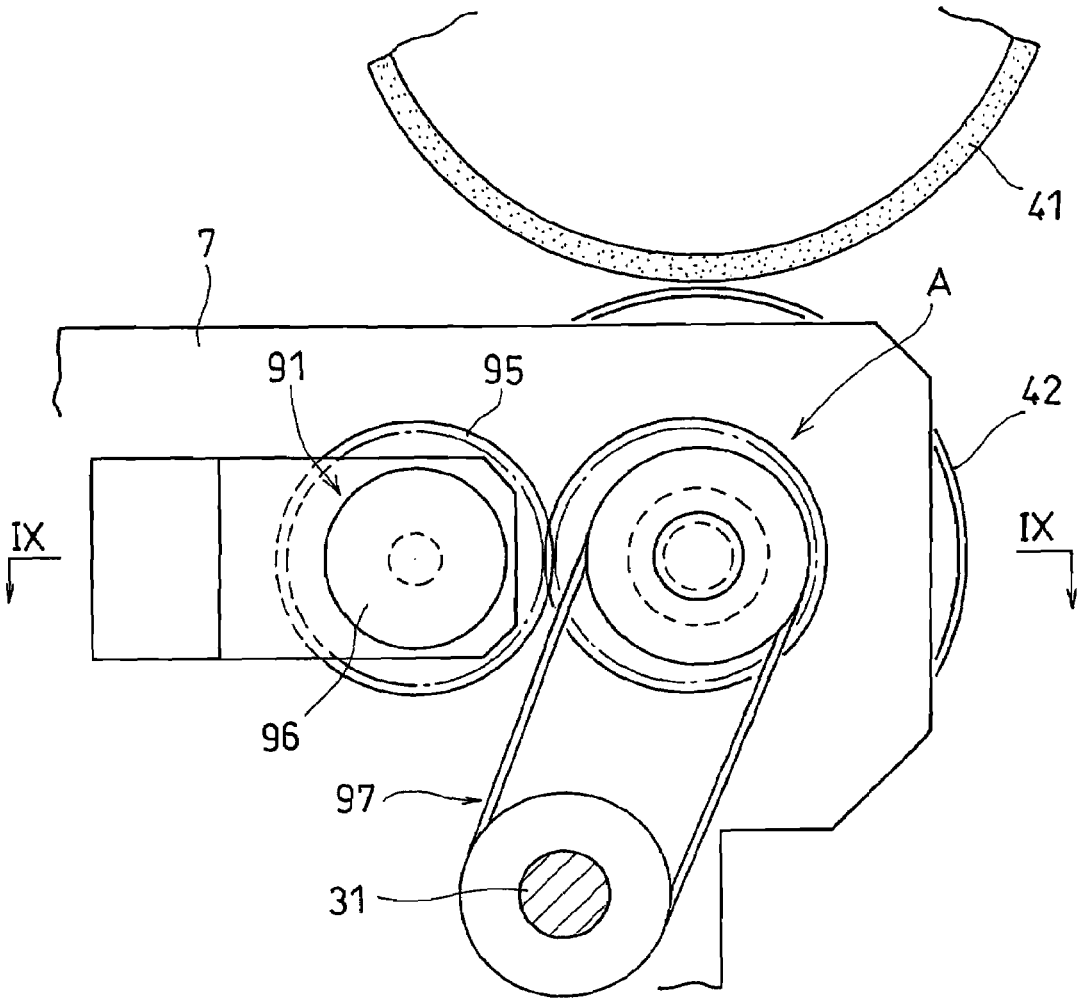
FIG. 8 is a front view of a different positioning means.
Figure 9:
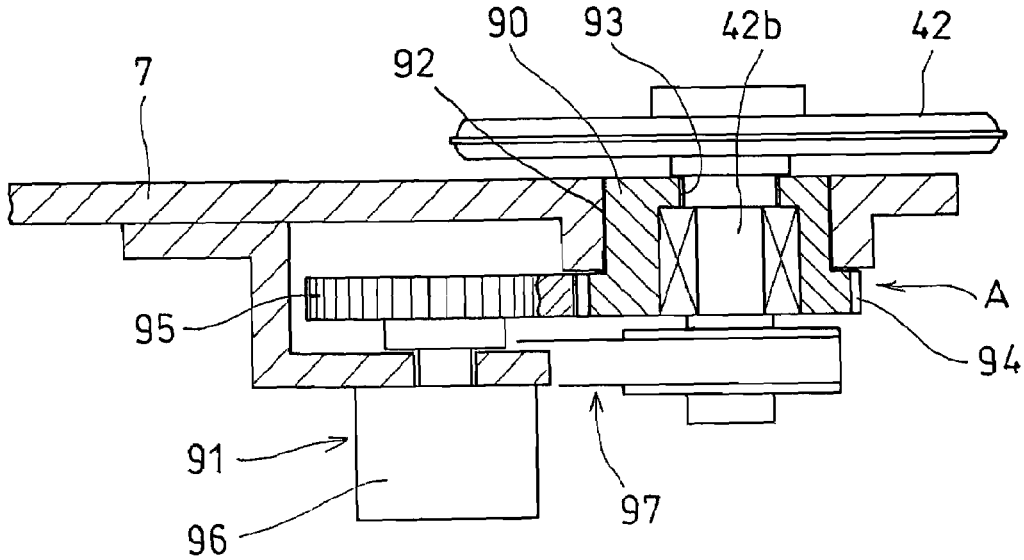
FIG. 9 is a sectional view taken along IX-IX of FIG. 8.

FIGS. 8 and 9 show a different positioning means A for positioning one of the male creasing rolls 42 supported by one of the lower movable frames 7 relative to the female creasing roll 41. This positioning means A can also be used for the positioning of the male creasing roll 42 supported by the lower stationary frame 5.

This positioning means A includes an eccentric bearing 90 rotatably supported by the lower movable frame 7, and a driving means 91 for rotating the eccentric bearing 90. The eccentric bearing 90 is formed with a support hole 93 located at an offset position from the axis of its cylindrical outer surface 92 and rotatably supporting the roll shaft 42*b* of the male creasing roll 42. The driving means 91 comprises a driving gear 95 which meshes with a gear 94 formed on the outer periphery of the eccentric bearing 90 at one end thereof, and a motor 96 for rotating the driving gear 95.

With this positioning means A, when the driving gear 95 is rotated by the motor 96, its rotation is transmitted to the gear 94, thus rotating the eccentric bearing 90. Thus, the axis of the roll shaft 42*b*, which is rotatably supported by the support hole 93, rotates about the center of rotation of the eccentric bearing 90. This causes the male creasing roll 42 to move relative to the female creasing roll 41. It is thus possible to adjust the distance between the male creasing roll 42 and the female creasing roll 41.

This positioning means A, in which the distance between the male creasing roll 42 and the backing roll (female creasing roll) 41 is adjusted by rotating the eccentric bearing 90, is simple in structure. The driving unit 91, which comprises the motor 96 and the driving gear 95, is also simple in structure.

In FIGS. 8 and 9, the rotation of the first drive shaft 31 is transmitted to the roll shaft 42*b* of the male creasing roll 42 through a belt transmission device 97.

In the embodiment, the male creasing roll 42 is movable relative to the female creasing roll 41. But instead, the female creasing roll 41 may be moved relative to the male creasing roll 42, or both the male and female creasing rolls 42 and 41 may be moved relative to each other.

In the embodiment, the four upper movable frames 6 are positionable relative to the upper stationary frame 4, while the four lower movable frames 7 are positionable relative to the lower stationary frame 5. But the upper stationary frame 4 and the lower stationary frame 5 may also be positionably provided.

What is claimed is:

1. A creasing device comprising a plurality of creasing units each comprising a male creasing roll having a creasing rib on its outer periphery, and a backing roll provided so as to oppose said male creasing roll over or under said male creasing roll, said plurality of creasing units being positionable in a direction transverse to a direction in which sheets are fed, wherein creases are formed in sheets while the sheets are being fed between said male creasing rolls and said backing rolls by rotating said male creasing rolls and said backing rolls in opposite directions to each other, characterized in that a plurality positioning means are provided respectively for said plurality of creasing units, each for positioning at least one of said male creasing roll and said backing roll of each creasing unit relative to the other, independently of the rolls of the other creasing units, and that said positioning means each comprise a roller arm pivotally supported at one end thereof on a drive shaft on which the roller arms of the other positioning means are pivotally supported, and supporting one of said male creasing roll and said backing roll that is to be positioned at the other end thereof, said drive shaft extending in a direction in which said plurality of creasing units are aligned, a nut member supported by said roller arm so as to be pivotable about an axis parallel to said drive shaft, a threaded shaft in threaded engagement with said nut member, and a motor for rotating said threaded shaft, whereby by rotating said threaded shaft, said nut member is moved axially of said threaded shaft, thereby pivoting said roller arm about said drive shaft.

* * * * *